United States Patent [19]

Valiulis et al.

[11] 4,394,909

[45] Jul. 26, 1983

[54] GUARD FOR A HANGER ASSEMBLY

[75] Inventors: Stanley J. Valiulis; Richard D. Barnes, both of Rockford, Ill.

[73] Assignee: Southern Imperial, Inc., Tupelo, Miss.

[21] Appl. No.: 197,576

[22] Filed: Oct. 16, 1980

[51] Int. Cl.[3] ..... A47F 5/00

[52] U.S. Cl. ..... 211/59.1; 248/220.3; 248/220.4

[58] Field of Search ..... 211/54.1, 87, 57.1, 211/106, 59.1, 60 T, 105.3; 248/220.3, 220.4, 221.1, 221.2, 220.2, 221.3, 223.3

[56] References Cited

U.S. PATENT DOCUMENTS

| | | | |
|---|---|---|---|
| 3,187,902 | 6/1965 | Nelson | 211/60 T |
| 3,534,864 | 10/1970 | Larson | 248/220.4 X |
| 3,912,084 | 10/1975 | Valiulis | 248/220.4 |
| 3,934,727 | 1/1976 | Brefka | 248/220.4 X |
| 3,954,182 | 5/1976 | McEvers | 211/105.3 X |
| 4,246,710 | 1/1981 | Mixer | 211/57.1 X |

FOREIGN PATENT DOCUMENTS

| | | | |
|---|---|---|---|
| 2447032 | 4/1976 | Fed. Rep. of Germany | 211/54.1 |
| 2726158 | 12/1978 | Fed. Rep. of Germany | 211/57.1 |

*Primary Examiner*—Ramon S. Britts
*Assistant Examiner*—Robert W. Gibson, Jr.
*Attorney, Agent, or Firm*—Leydig, Voit, Osann, Mayer & Holt, Ltd.

[57] ABSTRACT

Persons are prevented from being accidentally jabbed or snagged by the outwardly projecting arm of a "Pegboard hook" by a flexible guard adapted to overlie the arm and formed with a shield for substantially enclosing the outer end of the arm. The guard is formed by two slidably telescoped sections which may be adjusted to change the effective length of the guard and enable the guard to be used with hanger arms of different lengths.

9 Claims, 7 Drawing Figures

GUARD FOR A HANGER ASSEMBLY

BACKGROUND OF THE INVENTION

This invention relates generally to hangers for supporting articles on a perforated panel commonly known as a "Pegboard", and specifically deals with the problem of shielding the outwardly protruding end of the hanger arm.

Valiulis U.S. Pat. No. 3,912,084 discloses a flexible plastic guard for shielding the protruding end of a hanger arm. Although the material cost is low, the guard disclosed in the Valiulis patent must be molded by relatively complex and expensive dies. Introduction of the guard to the marketplace has been inhibited by the high cost of the dies and by the need for separate dies for each standard length of hanger arm.

SUMMARY OF THE INVENTION

The general aim of the present invention is to provide a universal guard which is adjustable to accommodate different standard lengths of hanger arms.

A further object of the invention is to provide a hanger guard which is easy to mold and assemble.

A more detailed object of the invention is to provide a new and improved guard which is formed by two telescopic sections adapted to overlie the hanger arm. One of the seconds is adapted to be attached to the perforated panel and is adapted to flex upwardly and downwardly to permit articles to be placed on and removed from the arm. The other section is formed with a shield for enclosing the outer end of the hanger arm and may be slid back and forth on the first section to enable the guard to be adjusted to accommodate hanger arms of different lengths.

The invention also resides in the relatively simple construction of the two sections of the guard and in the provision of detents for releasably holding the second section against sliding relative to the first section.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3, 4, 5, 6, 7:
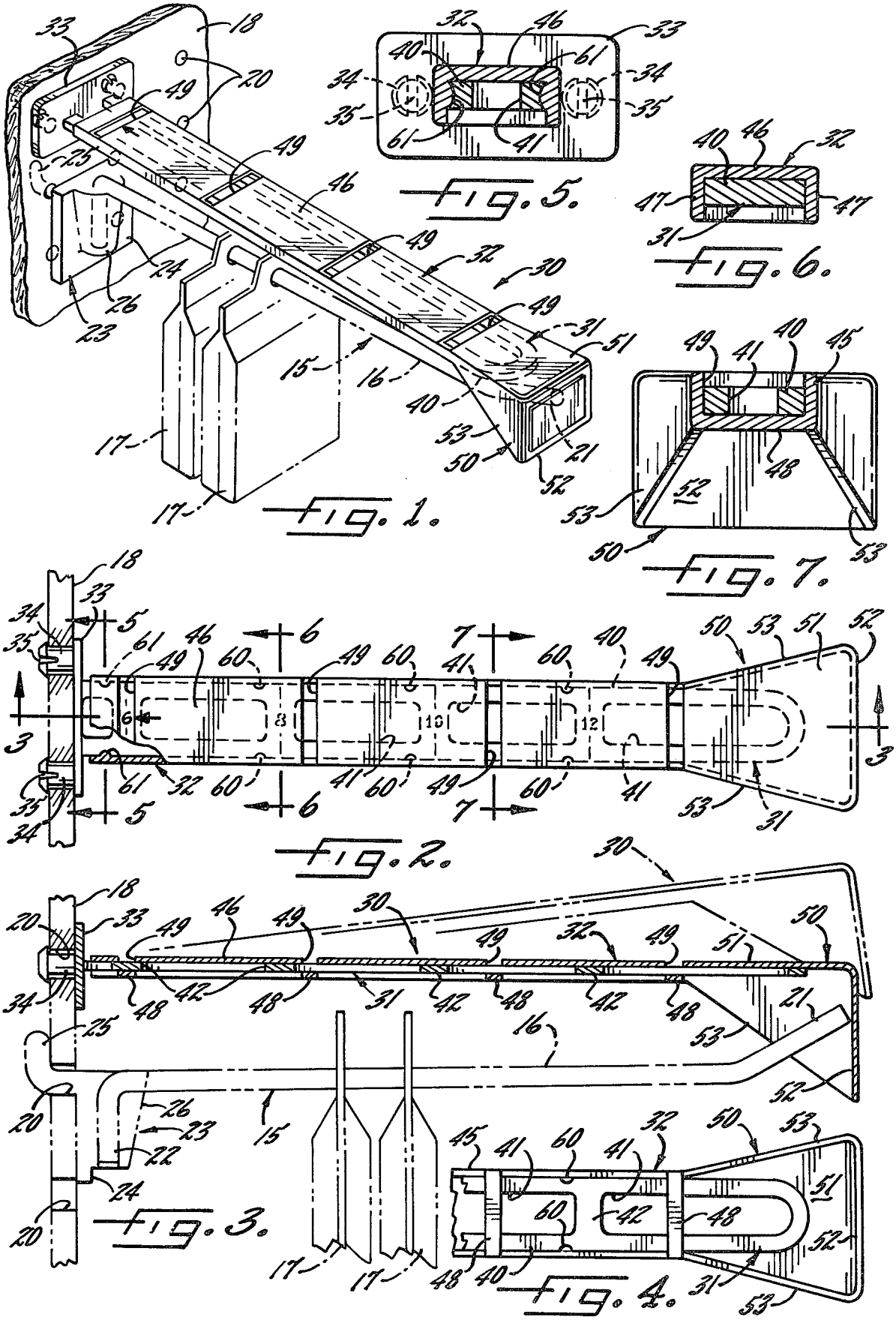
FIG. 1 is a perspective view showing the improved adjustable guard associated with a typical hanger assembly.
FIG. 2 is a top plan view of the guard shown in FIG. 1 with hanger assembly omitted for purposes of clarity.
FIG. 3 is a cross-sectional view taken along the line 3—3 of FIG. 2.
FIG. 4 is a fragmentary bottom view of the guard.
FIGS. 5, 6 and 7 are cross-sectional views taken along the lines 5—5, 6—6 and 7—7, respectively, of FIG. 2.

The present invention is shown as being associated with a hanger assembly 15 having a generally horizontal hanger arm 16 for supporting one or more articles 17 from a panel or Pegboard 18 of the type formed with a series of vertically spaced and horizontally extending rows of holes 20. In this instance, the articles have been illustrated as being bags within which merchandise is contained. The upper end portion of each bag is formed with a hole to enable the bag to be hung from the arm 16.

Herein, the hanger arm 16 is a metal rod-like element whose outer end portion or tip 21 (FIG. 3) is inclined upwardly through an angle of about 30 degrees so as to keep the bags 17 from sliding horizontally off of the arm. Depending from the inner end of the hanger arm 16 is a prong 22 (FIG. 3) which is fitted within a bracket 23 for attaching the assembly 15 releasably to the panel 18. In this instance, the bracket is molded of relatively rigid plastic such as Delrin and includes a generally rectangular plate member 24 normally disposed in an upright plane and adapted to lie flat against the outer face of the panel 18. Molded integrally with the upper end portion of the plate and projecting inwardly from the inner face thereof are two fingers or horns 25 (FIG. 3), each horn having a horizontal portion located adjacent the plate and merging gradually with an upwardly projecting vertical portion. By turning the plate 24 to a horizontal position with the ends of the horns pointing toward the panel 18 and by moving the plate edgewise, the normally vertical portions of the horns may be inserted into two horizontally spaced holes 20 in one of the horizontally extending rows of holes formed in the panel. Thereafter, the plate may be swung downwardly and toward the panel to cause the horizontal portions to enter the holes and to cause the vertical portions to enter the holes and to cause the vertical portions to engage and interlock with the rear face of the panel just above the holes as shown in FIG. 3.

An upright boss 26 (FIGS. 1 and 3) of generally semicircular cross-section is molded integrally with the outer side of the plate 24, the boss tapering downwardly and having an upper end located flush with the upper edge of the plate. A vertically extending hole of circular cross-section is formed through the center of the boss and opens out of the upper end of the boss to define a socket for receiving the prong 22 of the hanger arm 16. As an alternative to using the separate bracket 23, a U-shaped bracket (not shown) may be welded to the prong 22, such a bracket having a pair of L-shaped fingers similar to the horns 25 and positioned to straddle the prong.

Injury, particularly eye or facial injury, may be suffered by a person who might accidentally run into the tip 21 of the hanger arm 16 or otherwise be jabbed or snagged by the tip. To reduce the danger of such injury, a guard 30 is placed above the hanger arm 16 and shields the tip 21 thereof.

In accordance with the present invention, provision is made of an easy-to-mold guard 30 which may be quickly adjusted to accommodate hanger arms 16 of different lengths. As a result, the same guard can be used universally with hanger arms of various lengths so that the manufacturer of the guard need make only one model of guard and so that the ultimate user (e.g., a retail store) need only stock one model.

More specifically, the guard 15 is formed by two telescopic sections 31 and 32 (FIG. 4). The first section is made of resiliently yieldable material such as polypropylene and includes an upright mounting plate 33 adapted to lie against the outer face of the panel 18 above the bracket 23 of the hanger assembly 15. Formed integrally with and projecting rearwardly from the mounting plate are two horizontally spaced fingers 34 which are adapted to enter the pair of holes 20 immediately above the holes which receive the horns 25 of the bracket 23. Each finger 34 is partially divided as shown in FIGS. 3 and 5 by a vertical slot 35. The ends of the fingers are formed with tapered ears having a minimum diameter less than the diameter of the holes 20 and having a maximum diameter greater than the diameter of the holes. Since the fingers 34 are integral with the mounting plate 33, they are also molded from resiliently flexible plastic. Thus, the fingers 34 can be inserted into the smaller diameter holes 20 as the tapered ears resiliently flex inwardly. When the fingers are fully inserted, the ears expand and lock the fingers releasably in the holes to thereby attach the mounting plate 33 to the perforated panel 18.

Molded integrally with and projecting outwardly from the plate 33 is an elongated tongue-like male member 40 (FIG. 4) which forms part of the first section 31 of the guard 15. The tongue 40 extends cantilever fashion from the mounting plate 33 and, by virtue of the flexibility of the plastic, is capable of readily flexing upwardly and downwardly relative to the plate. Openings 41 are formed through the tongue 40 and are spaced along the length thereof in order to conserve plastic. The openings are separated by transversely extending webs 42 (FIG. 3).

The second section 32 of the guard 15 is formed by a channel-like female member 45 which has an inverted U-shaped cross-section. The channel 45 also is molded of plastic and is formed with a top wall 46 and with two depending side walls 47 (see FIG. 6). The transverse spacing between the side walls is approximately equal to the width of the tongue 40 and thus the channel 45 is adapted to telescope snugly but slidably over the tongue. Transversely extending and longitudinally spaced webs 48 (FIGS. 4 and 7) span the lower margins of the side walls 47 and prevent the channel 45 from being lifted away from the tongue 40. To facilitate molding of the webs 48, tool access openings 49 (FIG. 2) are formed through and are spaced along the top wall 46 of the channel 45 and are alined with the webs.

Formed integrally with the outer end of the channel 45 is a shield 50 which encloses and covers the top, sides and front of the tip 21 of the hanger arm 16. Herein, the shield includes a generally triangular horizontal upper wall 51 and an upright rectangular front wall 52 which depends from the front margin on the upper wall. Generally triangular side walls 53 depend from the side margins of the upper wall 51 and extend rearwardly from the front wall 52 to the outer end of the channel 45.

With the foregoing arrangement, the shield 50 substantially covers the tip 21 of the hanger arm 18 as shown in full lines in FIG. 3 when the channel 45 is telescoped over the tongue 40. Accordingly, the danger of a person being injured by the tip 21 is substantially reduced. In addition to shielding the front of the tip, the vertical front wall 52 of the shield 50 provides a surface upon which to place a price sticker or the like, the sticker being accessible to an electronic inventory wand.

When articles 17 are placed on or removed from the hanger arm 16, the shield 50 can be lifted upwardly away from the tip 21 of the hanger arm by flexing the guard 15 upwardly to the position shown in broken lines in FIG. 3. The flexibility of the tongue 40 permits such upward flexing of the guard.

The drawings show the guard 15 being used in conjunction with a relatively short (e.g., 6 inches) hanger arm 16. By simply sliding the channel 45 outwardly along the tongue 40, the effective length of the guard can be changed to enable the guard to be used with hanger arms of different standard lengths (e.g., eight, ten or twelve inches). To facilitate adjustment of the channel 45 and to hold the channel releasably in its adjusted positions, pairs of detent notches 60 (FIG. 2) are formed in the side edges of the tongue 40. Inwardly projecting detent lugs 61 (FIGS. 2 and 5) are formed on the inner sides of the side walls 47 of the channel 45 adjacent the inner end thereof. As the channel 45 is slid outwardly, the lugs snap into successive pairs of notches and releasably hold the channel against sliding. If desired indicia (e.g., the numbers 6, 8, 10 and 12) may be molded on the upper sides of the webs 42. As the channel is slid outwardly, the numbers become successively visible through the innermost opening 49 and indicate the effective length of the guard.

We claim:

1. A guard for a hanger assembly adapted to be attached to an upright perforated panel and having an outwardly extending hanger arm, said guard comprising an elongated first section having inner and outer ends, means for attaching the inner end of said first section to said panel in overlying relation with said hanger arm, said guard further comprising an elongated second section having inner and outer ends, said second section being telescoped with said first section and being selectively slidable inwardly and outwardly relative thereto to enable adjustment of the effective length of said guard, a series of first detents spaced along said first section, a second detent formed on said second section, said second detent successively engaging said first detents when said second section is slid inwardly and outwardly thereby to hold said second section releasably in selected adjusted positions along said first section, and said guard further comprising a shield on the outer end of said second section and located in front of the outer end of said hanger arm.

2. A guard as defined in claim 1 in which said means comprise an upright plate on the inner end of said first section, and a pair of horizontally spaced fingers projecting inwardly from said plate and adapted to telescope into holes in said panel.

3. A guard as defined in claim 2 in which said first section, said plate and said fingers are integral with one another and are molded from resiliently flexible plastic, said first section extending cantilever fashion from said plate and being capable of hinging upwardly and downwardly relative thereto by virtue of the flexibility of said plastic.

4. A guard as defined in claim 1 in which said second detent engages said first detents with a releasable snap fit.

5. A guard as defined in claim 1 in which said shield comprises an upper wall and further comprises an upright front wall depending from said upper wall.

6. A guard as defined in claim 5 in which said upper wall is generally triangular and in which said front wall is generally rectangular, said shield further including generally triangular side walls depending from said upper wall and extending rearwardly from said front wall to the outer end of said second section.

7. A guard for a hanger assembly adapted to be attached to an upright perforated panel and having an outwardly extending hanger arm, said guard comprising an upright mounting plate adapted to lie against the outer face of the panel, a pair of horizontally spaced fingers projecting inwardly from said mounting plate and adapted to telescope releasably into holes in said panel to secure said mounting plate releasably to said panel, an elongated male member extending outwardly from said mounting plate and adapted to overlie said hanger arm, said mounting plate, said fingers and said male member being integral with one another and being made of resiliently flexible material, said male member extending cantilever fashion from said mounting plate and being capable of hinging upwardly and downwardly relative thereto by virtue of the flexibility of said material, said guard further comprising an elongated female member telescoped slidably over said male member and selectively slidable inwardly and outwardly relative thereto to enable adjustment of the effective length of the said guard, coacting detents on said members for releasably holding said female member in selected positions along said male member, and said guard further comprising a shield integral with the outer end portion of said female member and shielding the top, sides and extreme outer end of the outer end portion of said hanger arm.

8. A guard for a hanger assembly adapted to be attached to an upright perforated panel and having an outwardly extending hanger arm, said guard comprising an elongated first section having inner and outer ends, means for attaching the inner end of said first section to said panel in overlying relation with said hanger arm, said guard further comprising an elongated second section having inner and outer ends, said second section being telescoped with said first section and being selectively slidable inwardly and outwardly relative thereto to enable adjustment of the effective length of said guard, said second section comprising a channel-shaped member of inverted U-shaped cross-section having a top wall and having two side walls depending from said top wall, transverse webs spaced longitudinally along said second section and extending between the lower margins of said side walls, said webs being engageable with the underside of said first section, and said guard further comprising a shield on the outer end of said second section and located in front of the outer end of said hanger arm.

9. A guard as defined in claim 8 further including openings formed in the top wall of said second section and overlying said webs.

* * * * *